US011499539B2

(12) United States Patent
Schmid

(10) Patent No.: US 11,499,539 B2
(45) Date of Patent: Nov. 15, 2022

(54) DIAPHRAGM PUMP

(71) Applicant: GARDNER DENVER THOMAS GMBH, Fürstenfeldbruck (DE)

(72) Inventor: Gunther Erich Schmid, Munich (DE)

(73) Assignee: GARDNER DENVER THOMAS GMBH, Furstenfeldbruck (DE)

( * ) Notice: Subject to any disclaimer, the term of this patent is extended or adjusted under 35 U.S.C. 154(b) by 714 days.

(21) Appl. No.: 16/085,458

(22) PCT Filed: Mar. 13, 2017

(86) PCT No.: PCT/EP2017/055775
§ 371 (c)(1),
(2) Date: Sep. 14, 2018

(87) PCT Pub. No.: WO2017/157819
PCT Pub. Date: Sep. 21, 2017

(65) Prior Publication Data

US 2019/0085842 A1 Mar. 21, 2019

(30) Foreign Application Priority Data

Mar. 17, 2016 (DE) ..... 10 2016 204 487.7

(51) Int. Cl.
*F04B 53/10* (2006.01)
*F04B 43/02* (2006.01)
(Continued)

(52) U.S. Cl.
CPC ..... *F04B 43/04* (2013.01); *F04B 45/047* (2013.01); *F04B 53/1007* (2013.01)

(58) Field of Classification Search
CPC .... F04B 1/07; F04B 9/04; F04B 9/045; F04B 27/073; F04B 53/1007; F04B 43/021;
(Continued)

(56) References Cited

U.S. PATENT DOCUMENTS 1,622,816 A 3/1927 Sperry
2,574,921 A * 11/1951 Johnson ..... F04B 3/006 417/463

(Continued)

FOREIGN PATENT DOCUMENTS

CN 85108378 A 12/1986
CN 101865100 A 10/2010

(Continued)

OTHER PUBLICATIONS

Chinese Patent Office Action for Application No. 201780017861.2 dated Jul. 16, 2019 (7 pages).

(Continued)

*Primary Examiner* — Dominick L Plakkoottam
*Assistant Examiner* — Charles W Nichols
(74) *Attorney, Agent, or Firm* — Edell, Shapiro & Finnan, LLC

(57) ABSTRACT

A diaphragm pump comprises a carrier part, a drive motor with a drive shaft, a pump head with a pump chamber delimited by a diaphragm, and an inlet port and outlet port. The pump head is connected to the drive shaft such that the direction of oscillation of the diaphragm is orthogonal with respect to the axis of rotation of the drive shaft. A drive transmission element is mounted on the pump head and is guided in a bearing disk mounted to be rotatable eccentrically, so as to be displaceable orthogonally with respect to the direction of oscillation of the diaphragm, such that the drive transmission element generates the oscillatory movement of the diaphragm in the pump chamber during the rotation of the pump head, and as a result of the rotation a pump medium line arranged therein is alternately connected to the inlet port and the outlet port.

20 Claims, 20 Drawing Sheets

(51) Int. Cl.
*F04B 43/04* (2006.01)
*F04B 45/047* (2006.01)

(58) Field of Classification Search
CPC .... F04B 43/023; F04B 43/025; F04B 43/026; F04B 45/04; F04B 45/041; F04B 45/043; F04B 45/047; F04B 49/123; F04B 49/125; F04B 49/128; F04B 43/04; F04B 53/10; F04B 53/102
See application file for complete search history.

(56) References Cited

U.S. PATENT DOCUMENTS

| | | | | | |
|---|---|---|---|---|---|
| 4,482,301 | A | * | 11/1984 | Schlick | F04B 49/005 417/317 |
| 4,824,336 | A | | 4/1989 | Iwaki et al. | |
| 4,936,758 | A | * | 6/1990 | Coble | F04B 43/0054 417/413.1 |
| 5,659,171 | A | * | 8/1997 | Young | H01J 49/288 250/281 |
| 5,676,527 | A | | 10/1997 | Ogikubo | |
| 2013/0183170 | A1 | | 7/2013 | Laermer | |

FOREIGN PATENT DOCUMENTS

| | | | | | |
|---|---|---|---|---|---|
| CN | 103147965 | A | | 6/2013 | |
| CN | 204851605 | U | | 12/2015 | |
| DE | 3122722 | A1 | | 12/1983 | |
| DE | 3416983 | A1 | | 11/1985 | |
| DE | 4405123 | A1 | | 8/1994 | |
| DE | 19954728 | A1 | | 5/2001 | |
| DE | 102012200501 | A1 | | 7/2013 | |
| EP | 0062990 | A1 | | 10/1982 | |
| FR | 727840 | A | | 6/1932 | |
| GB | 241956 | A | | 7/1926 | |
| GB | 661652 | A | * | 11/1951 | F01B 1/0689 |
| JP | 2009299530 | A | | 12/2009 | |
| WO | 1986004961 | A1 | | 8/1986 | |

OTHER PUBLICATIONS

International Search Report and Written Opinion for Application No. PCT/EP2017/055775 dated Jul. 3, 2017 (14 pages, English translation included).
German Patent Office Examination Report for Application No. 10 2016 204 487.7 dated Dec. 13, 2016 (4 pages).
German Patent Office Examination Report for Application No. 10 2017 211 775.3 dated Jan. 15, 2018 (5 pages).

* cited by examiner

DIAPHRAGM PUMP

CROSS-REFERENCE TO RELATED APPLICATIONS

This is a U.S. national stage entry of International Patent Application No. PCT/EP2017/055775, filed on Mar. 13, 2017, which claims priority to German Patent Application No. 10 2016 204 487.7, filed on Mar. 17, 2016, the contents of all of which are fully incorporated herein by reference.

The present patent application claims the priority of German patent application DE 10 2016 204 487.7, the content of which is incorporated by reference herein.

The invention relates to a diaphragm pump having the features specified in the preamble of patent claim 1.

Conventional diaphragm pumps have a pump housing for example in the form of a carrier part and a drive motor which is held thereon and which has a drive shaft which rotates about a main axis of rotation. A pump member in the form of a diaphragm, which delimits a pump chamber and is driven in oscillation by the drive shaft of the motor via a suitable eccentric drive, is arranged in a pump head.

An inlet port and an outlet port, which are each able to be alternately connected via a shuttle valve arrangement to the pump chamber in the sense of an intake stroke and exhaust stroke, are provided on the carrier part.

In conventional diaphragm pumps, said shuttle valve arrangement is formed by two passive check valves in corresponding inlet and outlet ducts from and to the pump chamber, which exhibit a certain disadvantageous dependence on changing ambient conditions. Moreover, a positive pressure difference between the inlet and outlet can lead to uncontrolled flow of pumping medium via the pump.

Furthermore, the check valves mentioned are generally formed as diaphragm valves which, with regard to their opening and closing behavior, are scarcely defined and are susceptible to wear in particular for dosing pumps.

Accordingly, such known diaphragm pumps are suitable only conditionally, in particular for high-precision dosage pumping.

Basically, in the case of dosing pumps, as a replacement for the diaphragm valves, which are recognized as being disadvantageous, valve constructions which have a valve disk and which are able to be alternately connected to corresponding kidney-shaped discharge ducts by way of a throughflow opening are known. Such disk valve constructions are known for example from DE 10 2012 200 501 A1, DE 31 22 722 A1 or DE 34 16 983 A1. In the case of such constructions, a problem is the difficult actuation of the valve disk, which, for example, is realized by way of a magnetically coupled actuator disk in the case of the construction according to DE 10 2012 200 501 A1.

The invention is accordingly based on the object of improving a diaphragm pump of the type mentioned in the introduction such that the pumping behavior becomes more defined and more precise and more independent of external influences.

Said object is achieved by the features specified in the characterizing part of claim 1. Accordingly, the diaphragm pump is characterized in that

- the pump head is mounted rotatably in the carrier part and is connected to the drive shaft in an orientation such that the direction of oscillation of the diaphragm is directed orthogonally with respect to the main axis of rotation of the drive shaft,
- there is provided for the diaphragm a drive transmission element, which

- firstly is mounted on the pump head so as to be displaceable in the direction of oscillation of the diaphragm and is connected to the diaphragm in terms of drive kinematics by way of a coupling element, and
  - is guided in a bearing disk, which is mounted so as to be rotatable eccentrically with respect to the main axis of rotation, so as to be displaceable orthogonally with respect to the direction of oscillation of the diaphragm, such that,
  - owing to the eccentricity-induced displacements of the drive transmission element relative to the pump chamber and to the bearing disk, the drive transmission element generates, by way of its coupling element, the oscillatory movement of the diaphragm in the pump chamber during the rotation of the pump chamber, brought about by the drive shaft, and the rotational driving along of the drive transmission element by the pump chamber, and,
- as a result of the rotation of the pump head, a pump medium line arranged therein is alternately connected to the inlet port and the outlet port.

By combining the features specified in the characterizing part of claim 1, a valve control which completely differs from the prior art is obtained. The rotation of the shuttle valve arrangement is practically generated by the rotating mounting of the pump head, with the drive of the diaphragm simultaneously being derived from said rotational movement via the drive transmission element, which is arranged eccentrically with respect thereto in a bearing disk and is able to be displaced relative to said disk and to the pump head. In summary, this results in a defined pumping behavior which is practically independent of the external conditions at the inlet port and outlet port. The valve arrangement itself is wear-resistant since diaphragm valves may be dispensed with.

In the dependent claims, preferred refinements of the subject matter of the invention are specified. In this regard, the drive transmission element may be formed as a cage-like part which is guided by way of sliding guides so as to be displaceable in relation to the pump head, on the one hand, and to the bearing disk, on the other hand. This constitutes a structurally simple embodiment for said component, by way of which the encircling relative movement of the drive transmission element brought about by the eccentricity of the mounting of the drive transmission element in relation to the pump head is made possible without any problems.

The coupling element of the drive transmission element may be formed as a coupling pin which projects inwardly into the pump head and which is connected to the diaphragm and thus, during the rotation, transmits the movement of the drive transmission element to the diaphragm in the sense of an oscillatory movement.

According to a further preferred embodiment, it is possible for the bearing disk to be mounted rotatably in a rolling bearing ring on the carrier part. This constitutes a particularly exact and easy-to-move mounting of the bearing disk, which, in the sense of exact rotational movement, proves to be particularly advantageous in particular in connection with the usage purpose of the diaphragm pump according to the invention as a dosing pump.

For the eccentricity of the mounting of the bearing disk in relation to the main axis of rotation, it is possible for dimensions of up to ⅓, preferably of up to ⅕, of the diaphragm clamping diameter to be specified, with approximately ⅒ being able to hold as an upper limit for flat diaphragms. For other types of diaphragms, such as bead diaphragms or rolling diaphragms, the larger eccentricities are then possible.

In order to integrate the initially mentioned design of a disk valve into the diaphragm pump according to the invention, a preferred refinement provides that the pump medium duct leads, in a manner parallel to, and at a distance from, the main axis of rotation in the pump head, from the pump chamber to a shuttle valve arrangement, having two kidney-shaped part-ring ducts, in the carrier part, via which the pump medium duct is able to be alternately connected to the inlet port and the outlet port of the pump in the sense of an intake stroke and exhaust stroke. Thus, not only the drive of the diaphragm but also the control of the shuttle valve arrangement is derived from the rotation of the pump chamber.

Preferred refinements of the shuttle valve arrangement provide the equipment with a rotating sealing disk having a valve opening via which the pump medium duct is able to be alternately connected to the inlet port and the outlet port. In particular if the shuttle valve arrangement is arranged on the carrier part under spring loading in the direction of the sealing disk, the valve arrangement permanently has intense sealing action. Furthermore, as a result of the sealing disk, it is possible with a correspondingly low-friction design for a wear-free, smooth movement of the diaphragm pump to be achieved.

A further preferred embodiment of the invention relates to the pump head, which may be made up of a bottom part and a top part together with a diaphragm clamped therebetween. The coupling element of the drive transmission element, that is to say in particular the coupling pin, then projects into the pump head through an opening in the bottom part for the purpose of connection to the diaphragm.

While a pump head having a pump chamber and correspondingly a pump member has been addressed until now, it is possible for advantageous refinements to be realized to the effect that two or even more pump chambers are provided mutually adjacently with pump members which move in an opposite or offset manner with regard to their stroke. Said pump members can then be driven jointly by the drive transmission element via separate coupling elements. Multiple pump chambers and diaphragms allow the delivery behavior of the diaphragm pump to be made more uniform without any losses in dosing accuracy for example in the case of a micro-dosing pump since the individual pump chambers operate in an offset manner in terms of stroke such that, when one pump chamber operates for example in the intake stroke, the other pump chamber is then running in the exhaust stroke.

The advantages of the diaphragm pump according to the invention with its preferred embodiments may be summarized as follows:

- Said pump is a compact diaphragm pump having controlled valves and a regulated motor.
- Due to the specific eccentric drive, the diaphragm is actuated in a strictly linearly manner, this allowing a very stiff design and a PTFE coating of the diaphragm.
- The valve construction requires only static sealing and no bending elastomers. This leads to pumps with very high chemical durability and a long lifetime. Furthermore, the pump exhibits no tendency to leak with respect to the environment.
- Irrespective of the running of the motor or any stop position of the motor, there is never an open flow path between the inlet and the outlet of the pump in any direction.
- The construction of the pump chamber and the valves avoids volume regions without direct contact with the liquid stream. Accordingly, the flushing and cleaning of the pump head is simple to realize.
- A stiff diaphragm in conjunction with controlled valves leads to optimized pressure and suction properties for gases, liquids and mixtures of gases and liquids.
- In conjunction with a speed- and direction-controlled motor, as may be realized for example by a stepper motor, the pump stream is able to be set exactly and can furthermore be easily reversed by way of a reversal of direction of the motor rotation. Owing to the low elasticities in the entire structure, the flow rate is highly constant with respect to time and environmental influences are minimized. The flow is almost independent of varying back or inlet pressure, and even remains constant when a positive pressure prevails at the inlet of the pump.
- By way of optional position detection, it is possible for erroneous steps, such as for example omitted steps, of the stepper motor to be compensated. This also allows a quite specific, defined volume to be delivered through counting of the motor revolutions.
- Overall, the pump according to the invention exhibits high flow precision of, for example, 1 percent and less. It is smooth and operates with very low vibrations.
- The real construction of the diaphragm pump for the serial production is highly adaptable to the respective requirements of the application. In this regard, the flow rates are scalable to orders of magnitude between μl/min and l/min. The material of the wetted regions may correspond to the required chemical durability. The liquid ports are arranged at the top of the head of the pump, with their detailed position and orientation being freely selectable. For the wetted parts of the pump, high ease of maintenance, for example for a straightforward replacement, can be achieved. The robust design of the pump parts also allow media with high viscosities to be delivered.

Further features, details and advantages of the invention will emerge from the following description of an exemplary embodiment on the basis of the appended drawings. In the drawings:

FIG. 1 shows a perspective illustration of a diaphragm pump,

FIG. 2 shows a detail axial section of the pump as per section line II-II in FIG. 1, FIG. 3 shows a radial section through the pump as per section line III-III in FIG. 2, FIG. 4 shows a side view of a schematically illustrated diaphragm pump, FIG. 5 shows a view of the diaphragm pump as per arrow direction V in FIG. 4 in a neutral position of the diaphragm, FIG. 6 shows an axial section along the section line VI-VI in FIG. 5, FIG. 7 shows a radial section along the section line VII-VII in FIG. 4, FIGS. 8 to 10 show illustrations of the diaphragm pump analogous to FIGS. 5 to 7 in a position of the pump head which has rotated through 45° in relation to the neutral position, with a drive cage.

Figure 1:
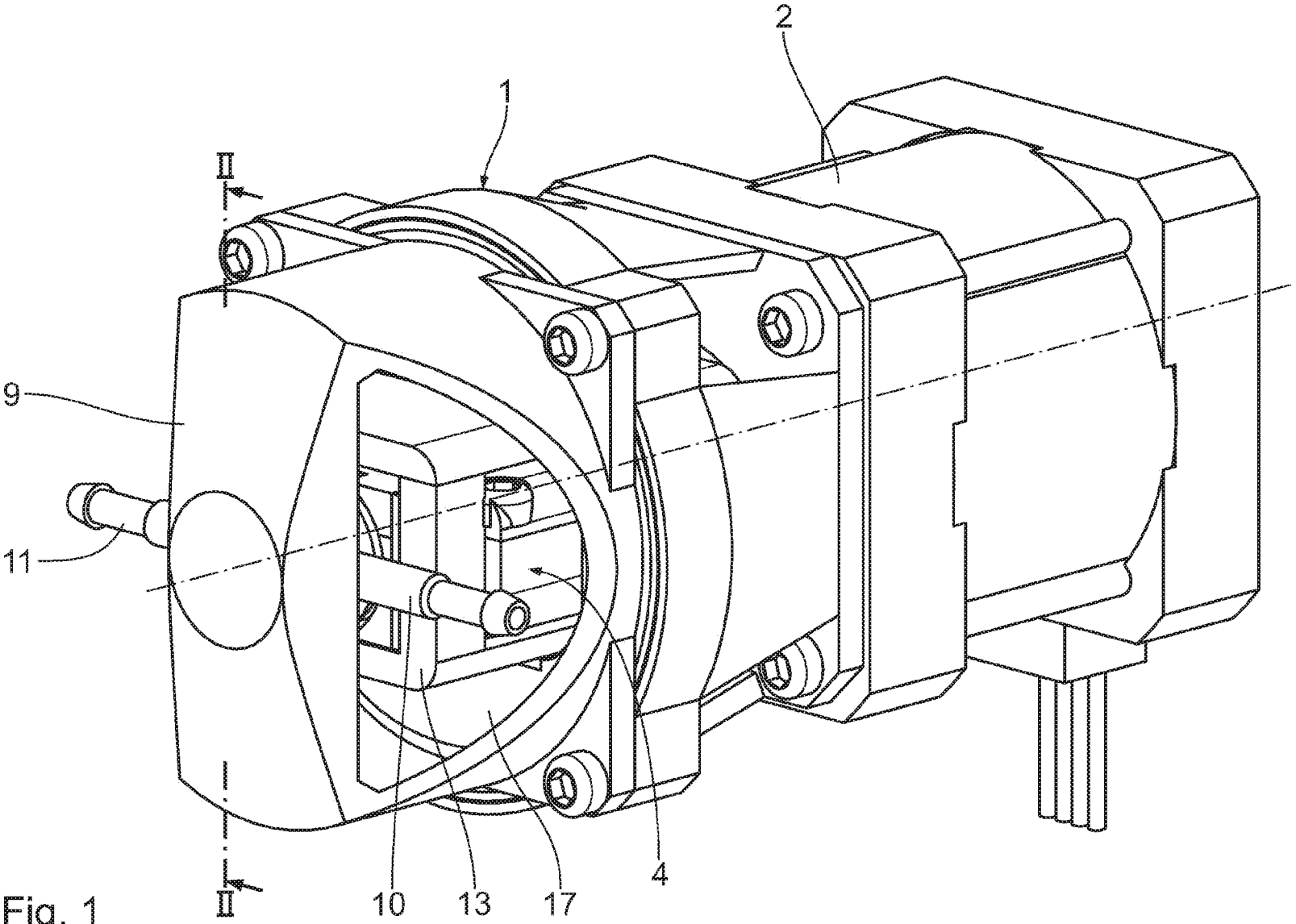
Figure 2:
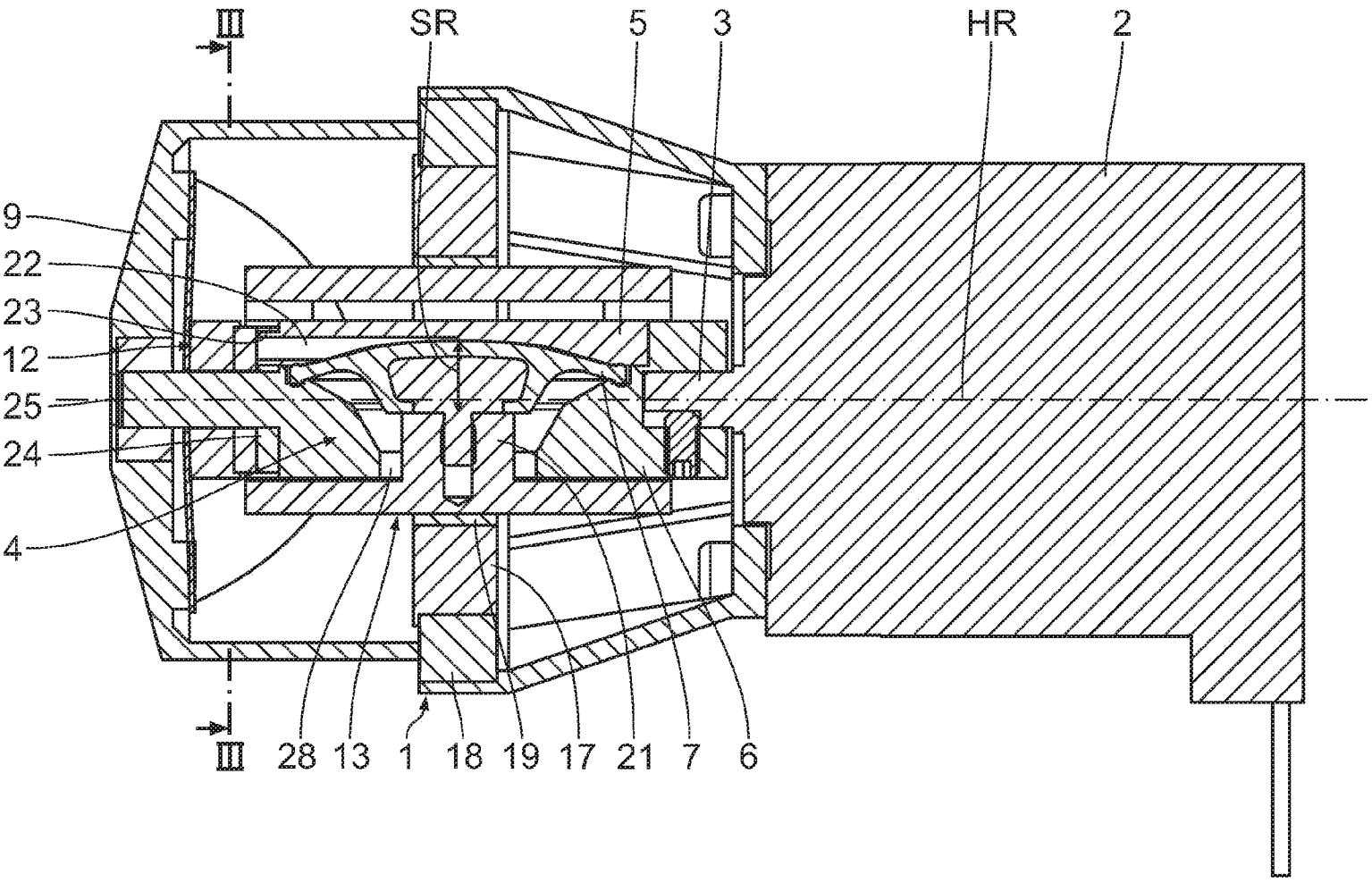
Figure 4:
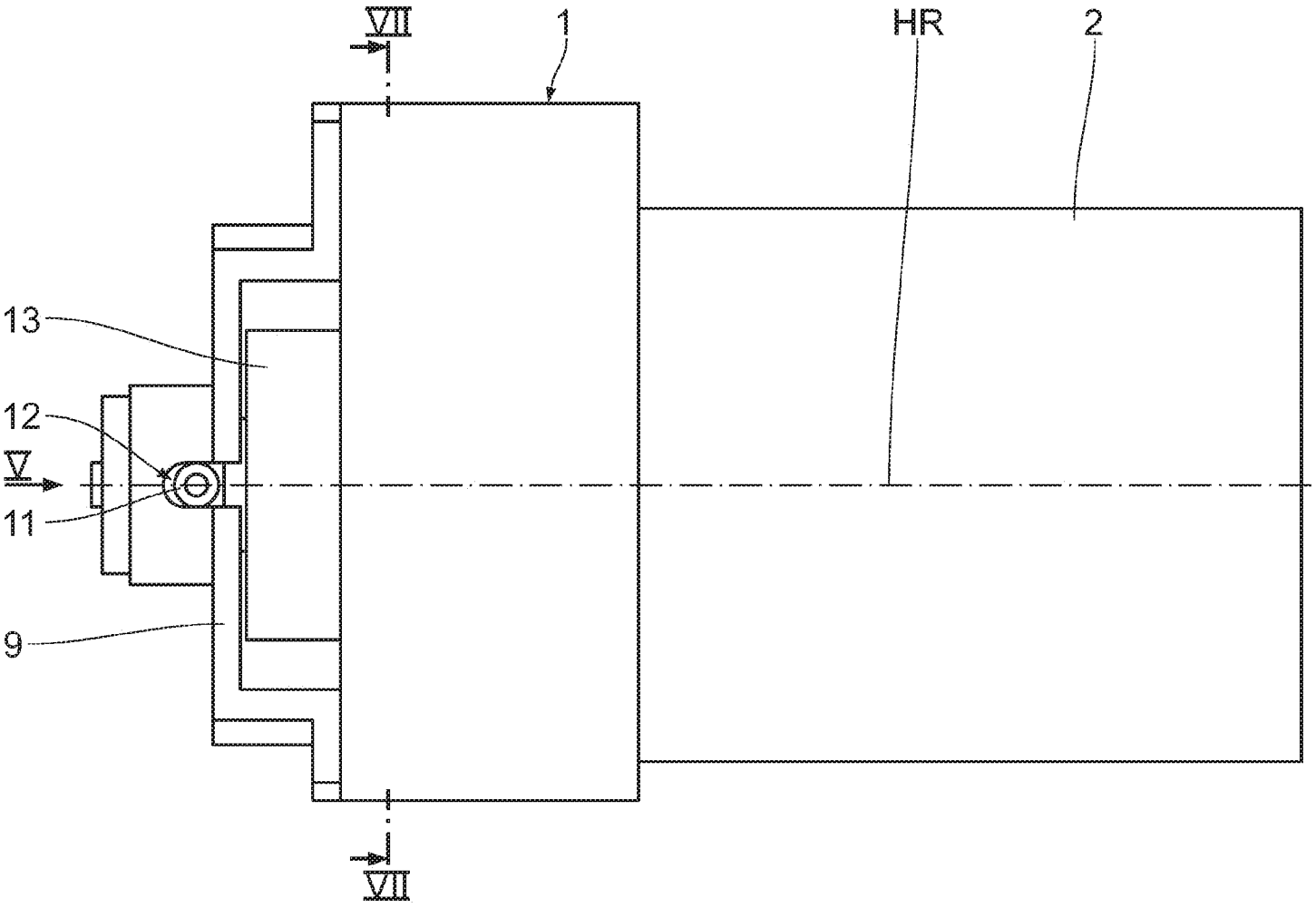

As becomes clear from FIGS. 1 and 2, the diaphragm pump shown has a frame-like carrier part 1 which functions as a pump housing and to which an electric drive motor 2 is attached. The drive motor 2, which is indicated merely schematically in FIG. 4 ff., has a drive shaft 3 which rotates about a main axis of rotation HR. A pump head, denoted in its entirety by 4, is made up of a top part 5 and a bottom part 6, which delimit a conventional lenticular working space. Clamped between the top part and the bottom part 5, 6 in said space is a diaphragm 7 which, together with the top part 5, delimits the pump chamber 8. The pump head 4 is mounted rotatably in the carrier part 1 in a manner to be discussed in more detail and is in this case connected to the drive shaft 3 in an orientation such that the direction of oscillation SR of the diaphragm 7 is directed orthogonally with respect to the main axis of rotation HR of the drive shaft 3.

Figure 3:
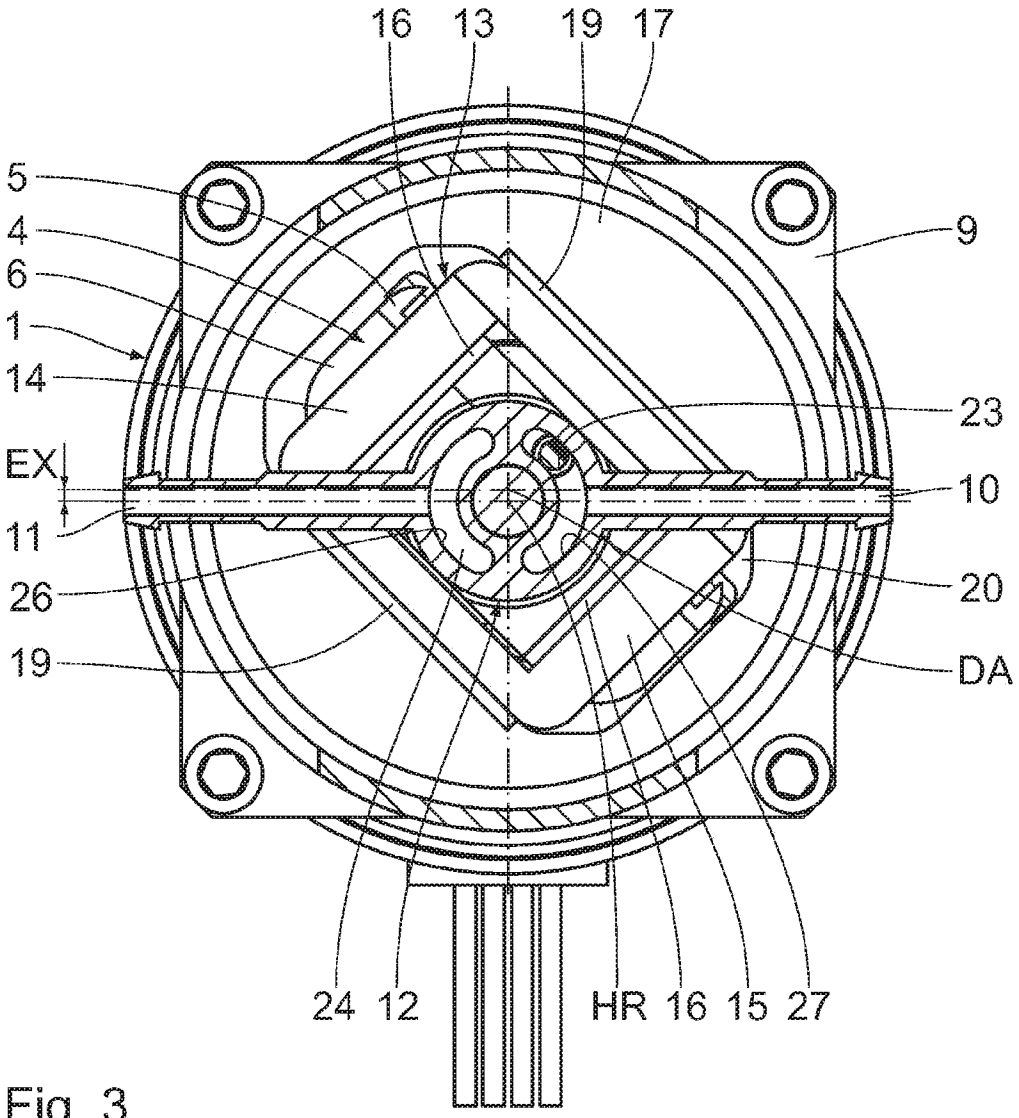

As can be seen from FIGS. 1 and 3, there is provided on the carrier part 1, on the side averted from the drive motor 2, a bearing bridge 9 from which pipe-like outlet and inlet ports 10, 11 project in directions which face away from one another. Said ports 10, 11 are provided with a shuttle valve arrangement, denoted in its entirety by 12, which is able to be alternately connected to the pump chamber 8 in the sense of an intake stroke and exhaust stroke. Its function will be discussed in more detail below.

For the purpose of driving the diaphragm 7 in the pump head 4, a drive transmission element 13 is provided, this being referred to below as a drive cage 13 for the sake of simplicity. Said drive cage 13 is firstly, as becomes clear for example from FIGS. 3 and 7, mounted on the pump head 4 by way of lateral struts 14, 15 via sliding guides 16 so as to be displaceable in the direction of oscillation SR of the diaphragm 7. Furthermore, the drive cage 13 is seated in a bearing disk 17 which is mounted rotatably in a rolling bearing ring 18, serving as a rotary bearing, on the carrier part 1. The drive cage 13 is in turn mounted in the bearing disk 17 via sliding guides 19 so as to be displaceable in a direction which is directed orthogonally with respect to the guidance direction of said cage at the pump head 4. For this purpose, the receptacle 20 of the sliding guide 19 in the bearing disk 17 for the drive cage 13 is formed to be wider than the corresponding dimension of the drive cage. In the same manner, the opening, present in the drive cage 13, with the sliding guides 16 for the guidance on the pump head 4 is formed to be wider than the corresponding dimension of the pump head 4. Thus, the drive cage 13 within the receptacle 20 and the pump head 4 are able to be displaced relative to one another in the direction of oscillation SR of the diaphragm 7 and orthogonally with respect thereto.

Figure 9:
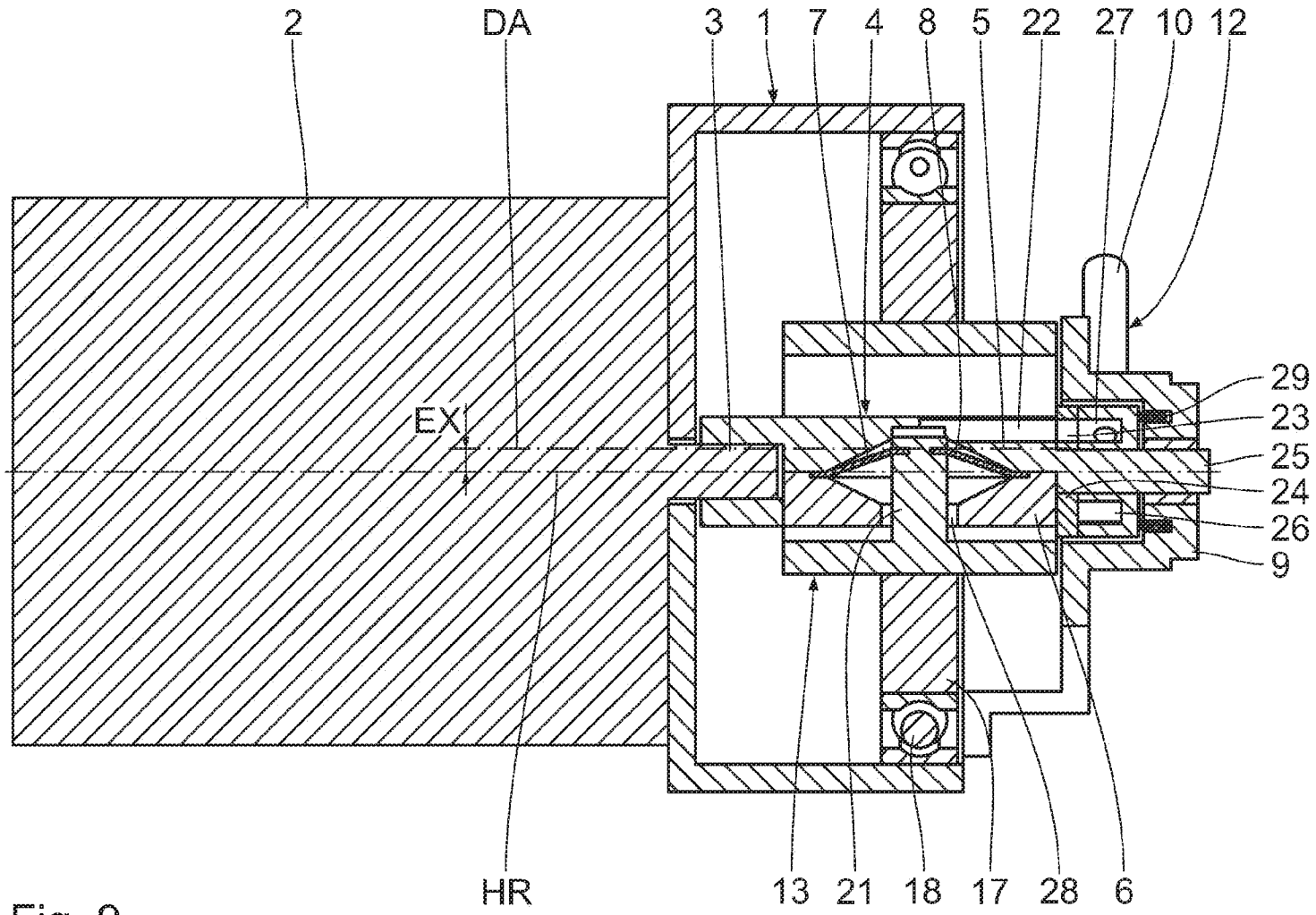
Figure 12:
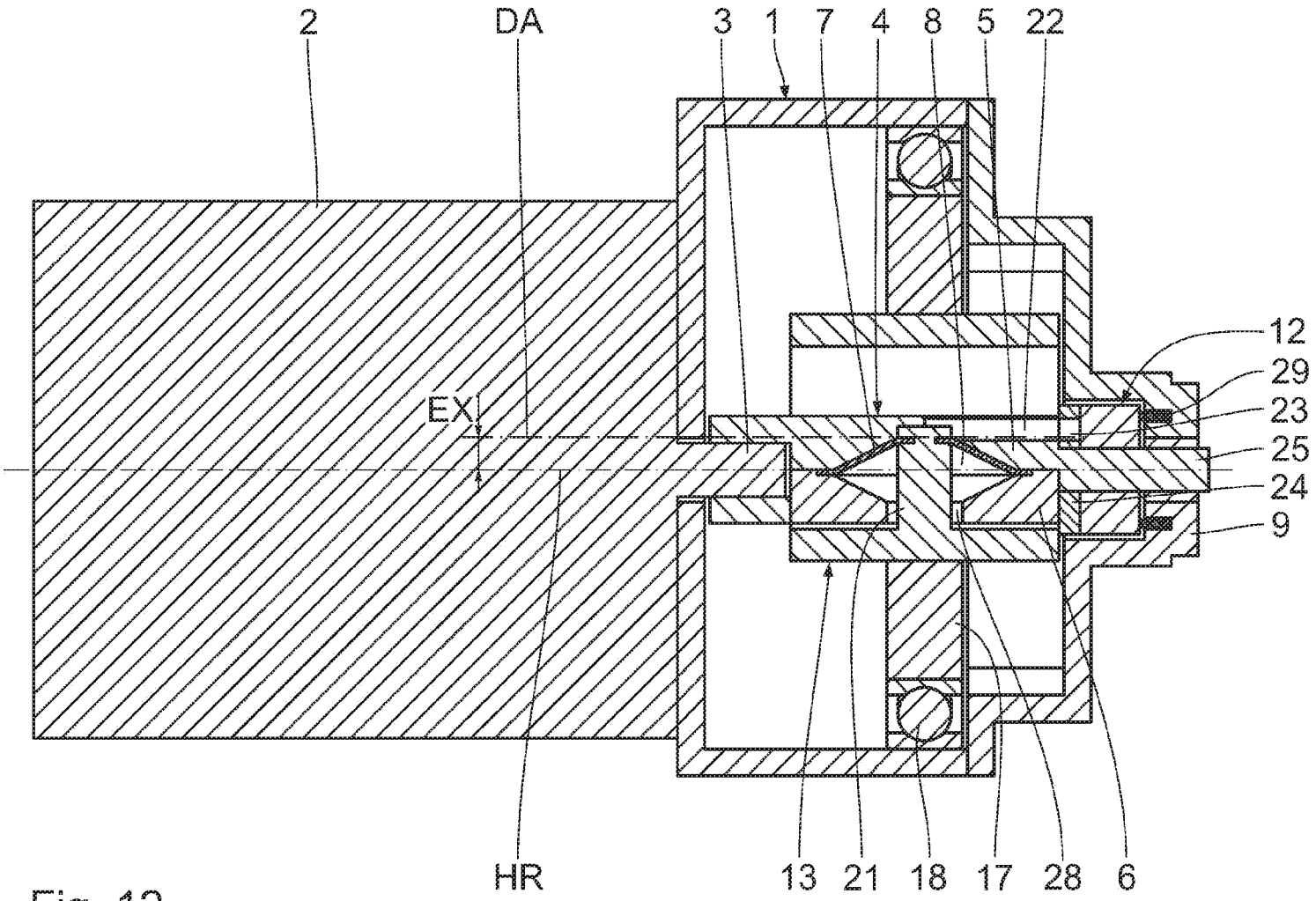
Figure 15:
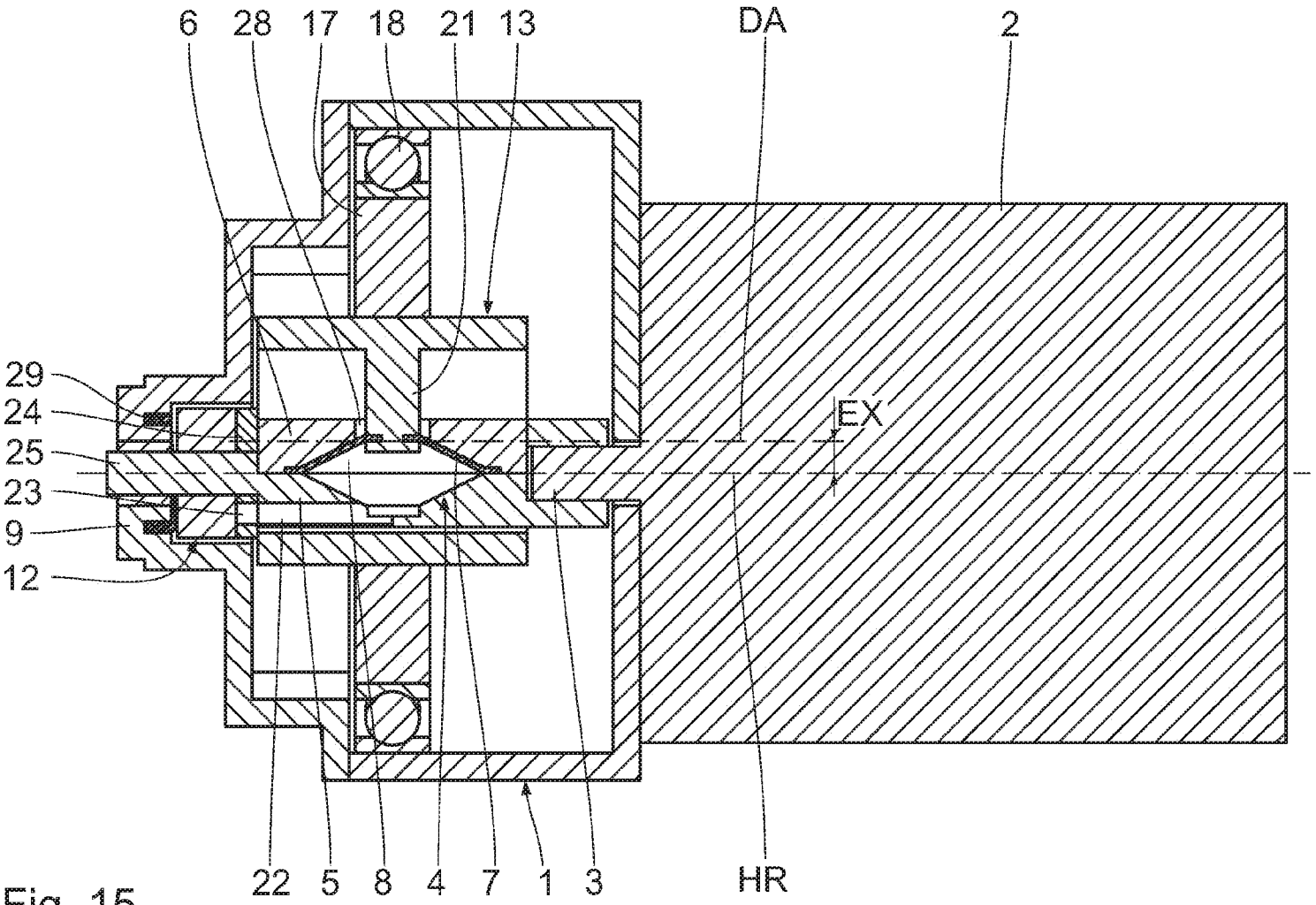

As can be seen from FIG. 3, and particularly clearly from FIGS. 9, 12 and 15, the bearing ring 17 is, with its rolling bearing ring 18, arranged on the carrier part 1 such that the axis of rotation DA of the bearing disk 17 is arranged parallel to the main axis of rotation HR but so as to be offset by an eccentricity EX with respect thereto.

Finally, it is to be noted that the drive cage 13 has, as a coupling element for coupling to the diaphragm 7, a coupling pin 21 which projects inwardly into the pump head 4 and at whose end the diaphragm 7 is fastened centrally. The coupling pin 21 has access to the diaphragm 7 via an opening 28 in the bottom part 6 of the pump head 4.

As becomes clear from FIGS. 2, 6, 9, 12 and 15, a pumping medium duct 22 departs from the pump chamber 8 on the side facing away from the coupling pin 21, said duct running toward the shuttle valve arrangement 12 in a manner parallel to the main axis of rotation HR and offset at a distance therefrom and opening into the valve opening 23 of a valve disk 24. The latter rotates together with the pump head 4, which, on this side, is mounted rotatably in the carrier part 1 via an axle stub 25.

Figure 17:
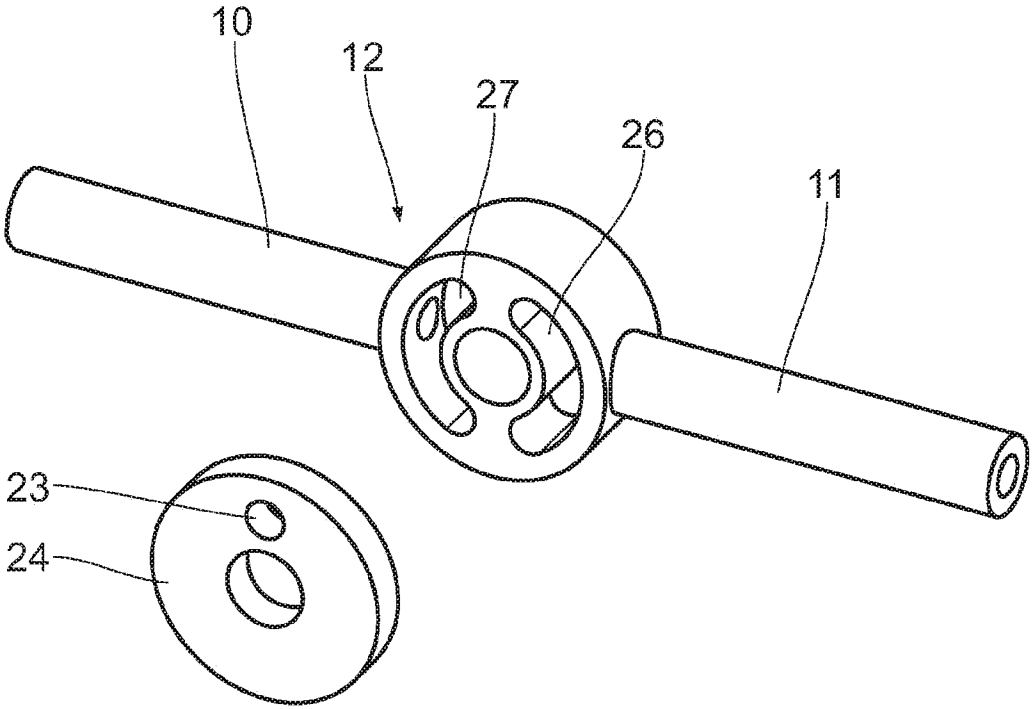
FIG. 17 shows a perspective exploded illustration of the shuttle valve arrangement of the diaphragm pump.

The valve disk 24 with the valve opening 23 cooperates with the shuttle valve arrangement 12, in which—as becomes clear from FIGS. 3 and 17—two kidney-shaped part-ring ducts 26, 27 are introduced on a circular line corresponding to the encircling diameter of the valve opening 23 and are fluidically connected to the inlet port 11 and the outlet port 10.

Figure 5:
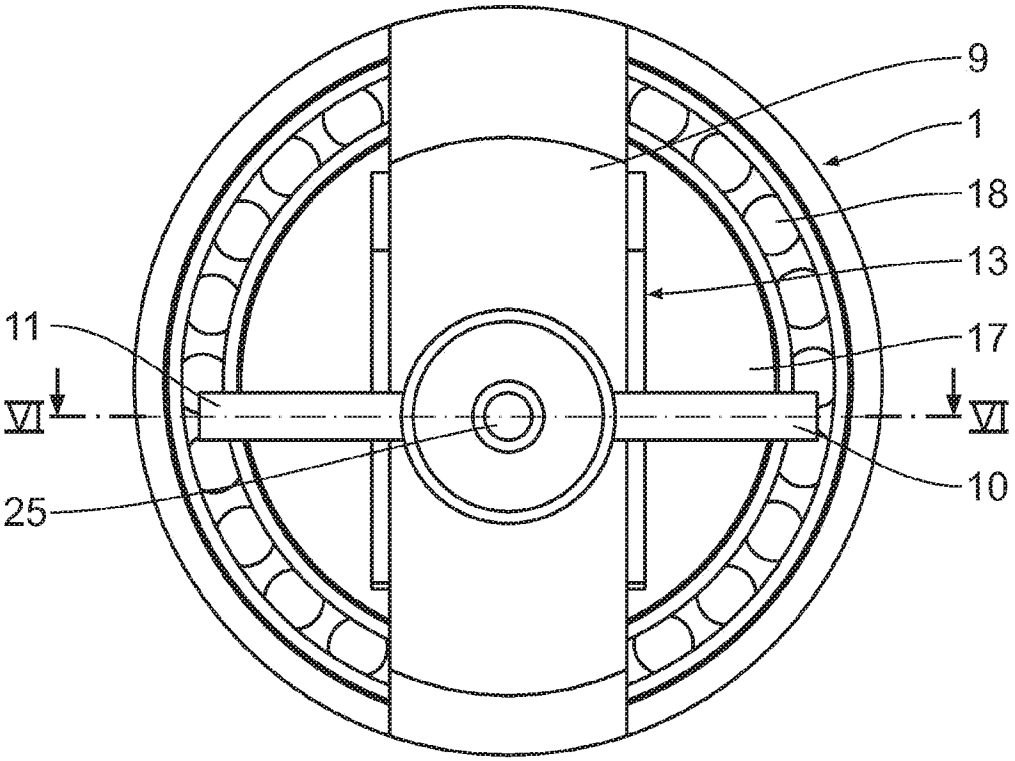
Figure 6:
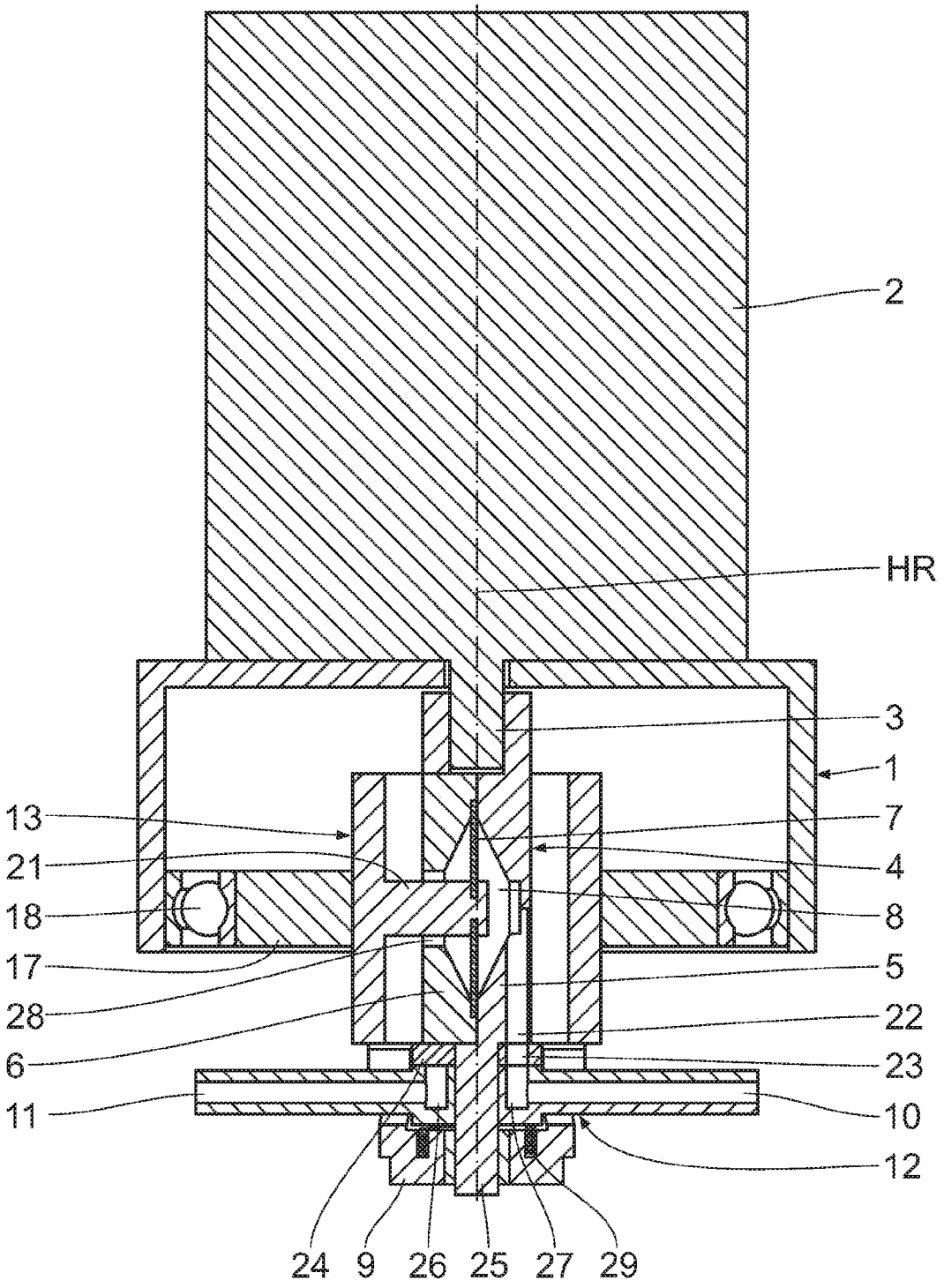
Figure 7:
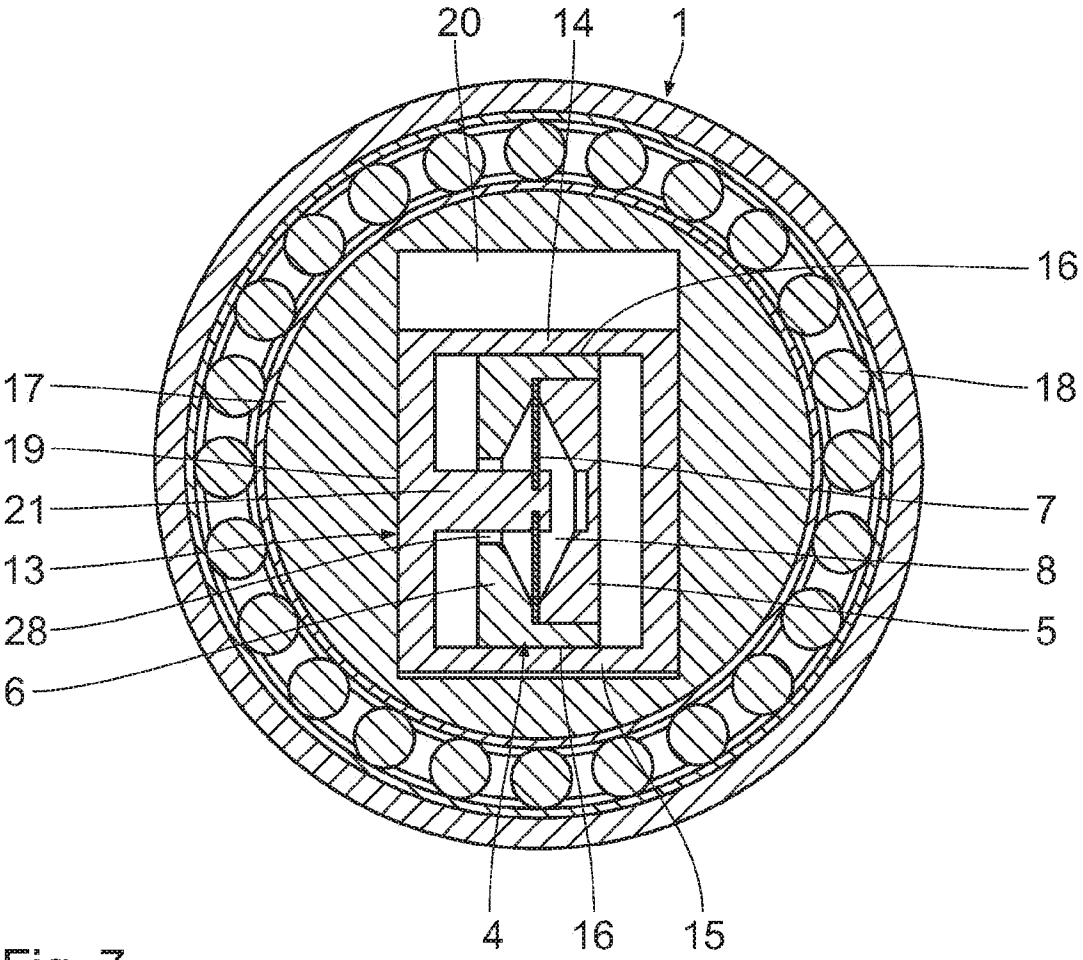
Figure 8:
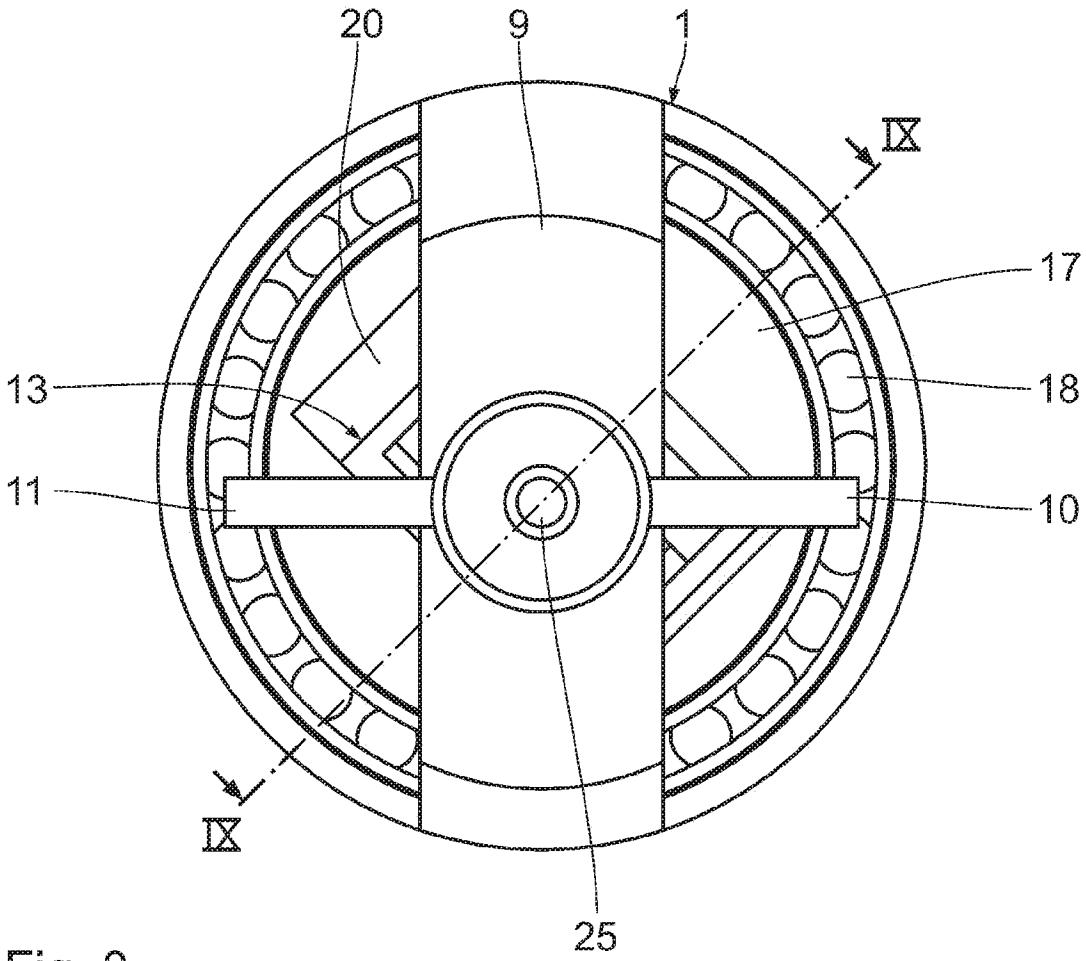
Figure 10:
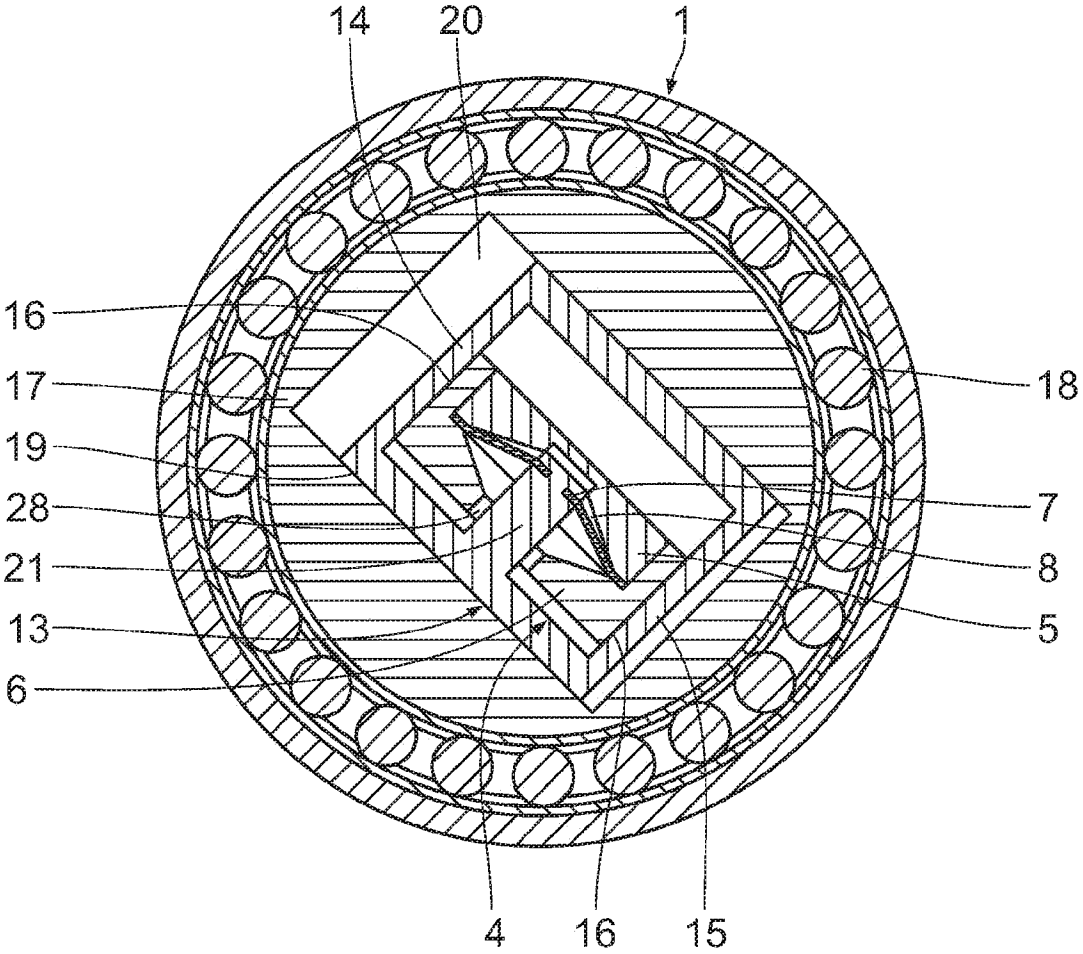

The functioning of the diaphragm pump shown in FIGS. 1 to 17 may be described as follows:

In FIGS. 5 to 7, the diaphragm pump is shown in the neutral position of the diaphragm 7, that is to say the central position between the bottom dead center and the top dead center. During a rotation of the pump head 4 induced by the drive motor 2, the pump head 4 is rotated and drives along the drive cage 13 via the sliding guides 16. Owing to the eccentricity EX of its mounting in the bearing disk 17 in relation to the main axis of rotation HR, about which the pump head 4 rotates, the drive cage 13 is displaced along the sliding guides 16 and 19 relative to the pump head 4 and the bearing disk 17 during said rotation, as a result of which the drive cage 13 engages, with its coupling pin 21, deeper into the pump head 4 and accordingly moves the diaphragm 7 in the direction of its top dead center. A 45° intermediate position for this movement is shown in FIGS. 8 to 10.

Figure 11:
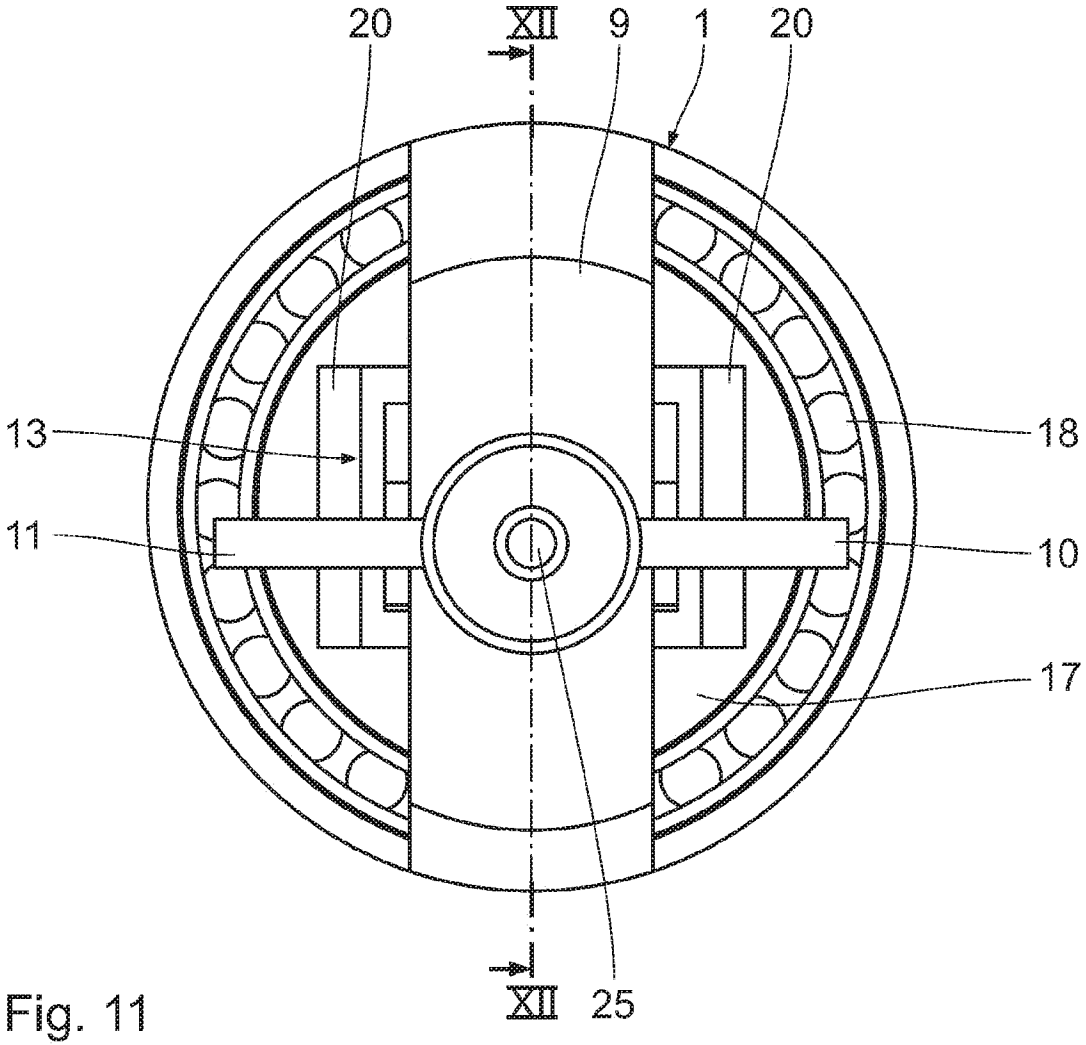
FIGS. 11 to 13 show illustrations of the diaphragm pump analogous to FIGS. 5 to 7 at the top dead center of the pump head, with a drive cage.
Figure 13:
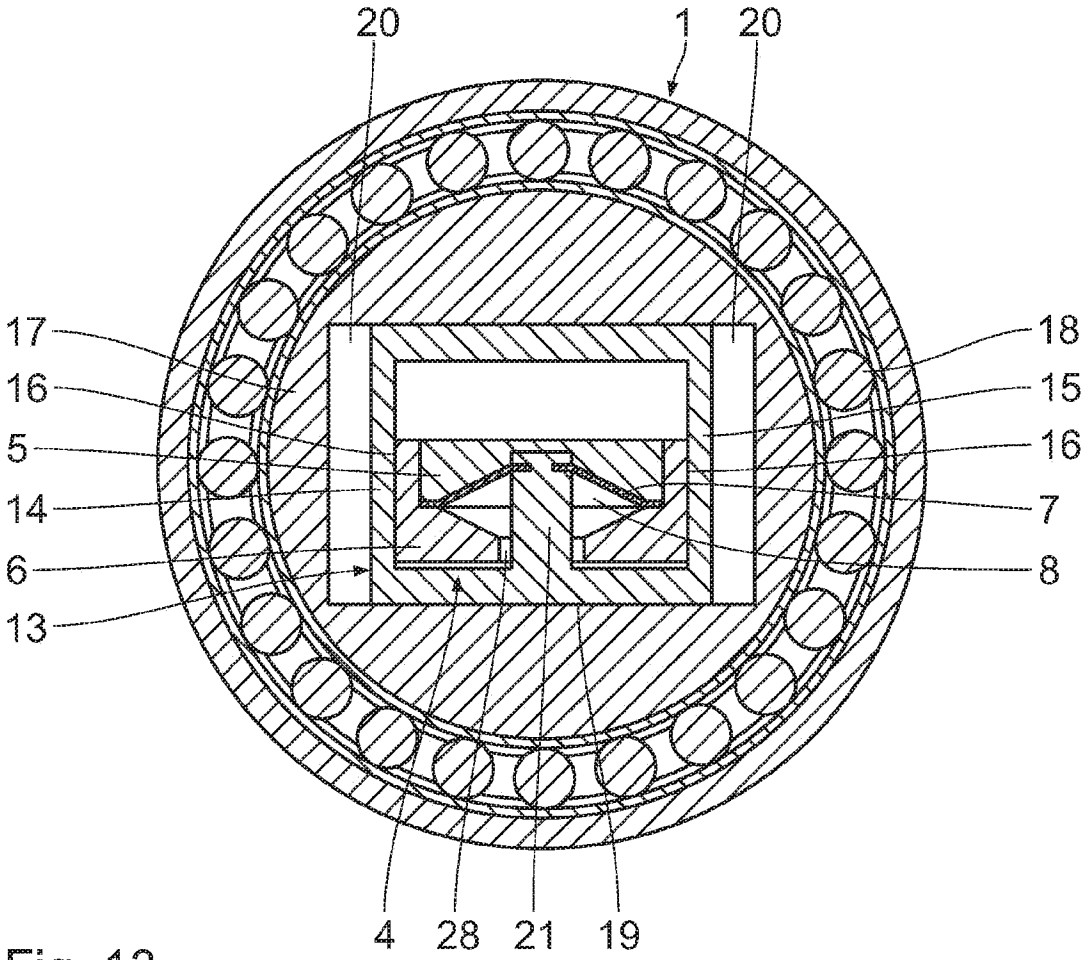

During further rotation of the drive shaft 3 of the pump head 4, the drive cage is displaced further relative to the pump head 4 until the diaphragm has reached the top dead center, as is illustrated in FIGS. 11 to 13. The pump head 4 has rotated through 90° in relation to the neutral position shown in FIGS. 5 to 7. The corresponding movement of the diaphragm 7 corresponds to the exhaust stroke of the diaphragm pump, during which the pumping medium duct 22 conducts via the valve opening 23 by way of the one part-ring duct 27, the latter being connected to the outlet port 10. The medium which is present in the pump chamber 8 is thus discharged through the outlet port 10. When the top dead centre of the diaphragm 7 is reached, the angle of rotation of the pump head 4 is also such that the pumping medium duct 22 leaves, with the valve opening 23 in the valve disk 24, the overlap with the part-ring duct 27, with the result that the pumping medium duct 22 is closed off in a sealed manner at this moment.

Figure 14:
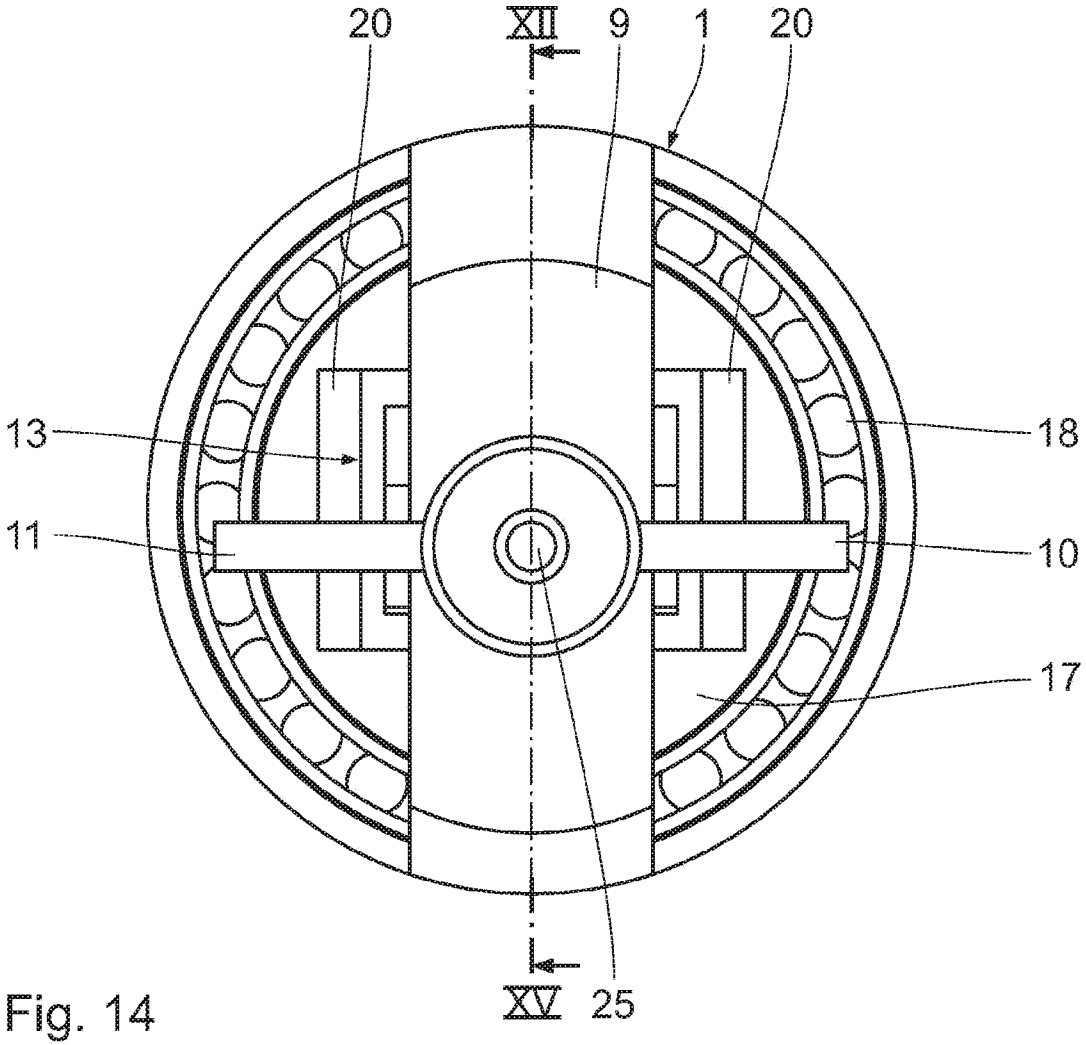
FIGS. 14 to 16 show illustrations of the diaphragm pump analogous to FIGS. 5 to 7 at the bottom dead center of the pump head, with a drive cage.
Figure 16:
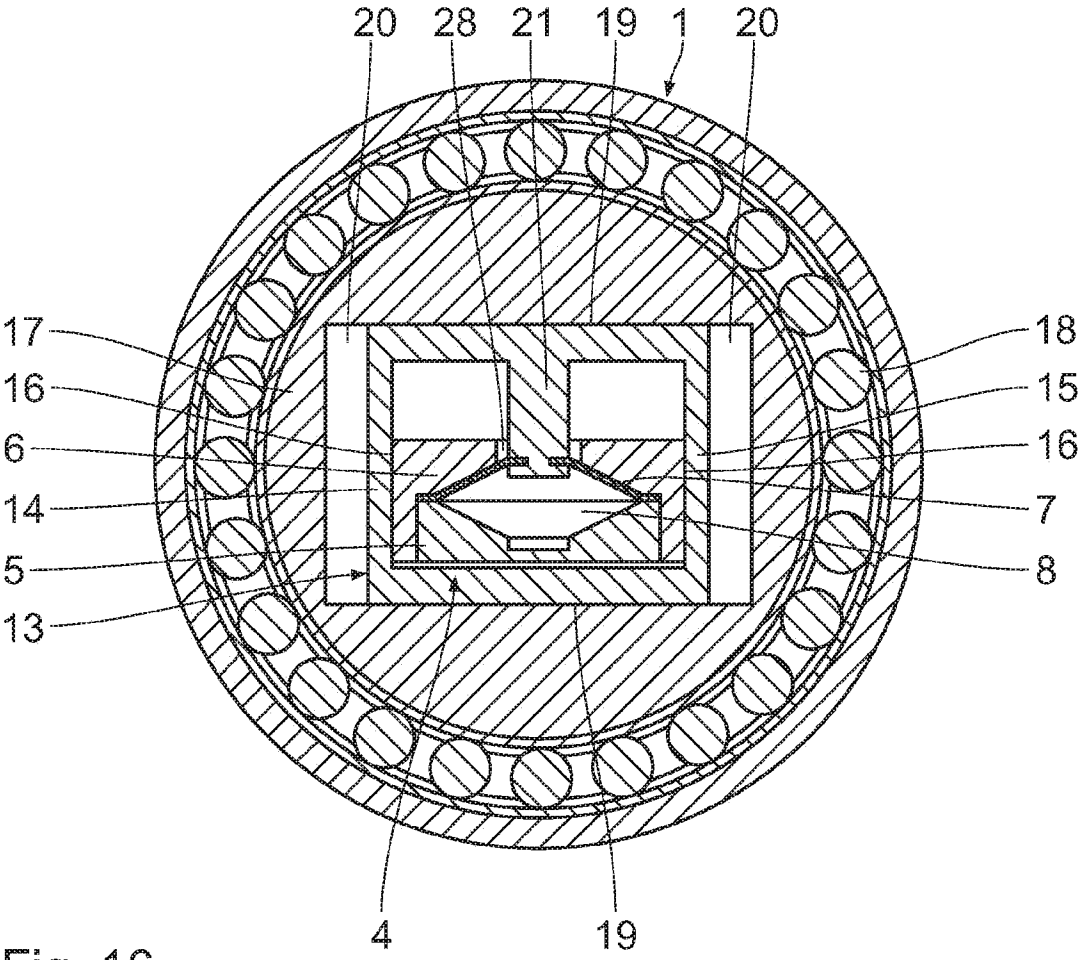

During further rotation of the drive shaft 3 with the pump head 4 through 180°, a reversal of the relative movement of the drive cage 13 with respect to the pump head 4 occurs, and the neutral position is moved through again before the bottom dead centre position of the drive cage 13 with the diaphragm 7, which position is shown in FIGS. 14 to 16, is reached. During this rotational movement, the pump medium duct 22 overlaps, with the valve opening 23 in the valve disk 24, the second part-ring duct 26 such that, during this intake stroke, it is possible for pumping medium to be drawn into the pump chamber 8 via the inlet port 11. When the bottom dead center is reached, the pumping medium duct 22 is, with the valve opening 23, outside the region of overlap with the part-ring duct 26 again, and the pump chamber 8 is closed off in the filled state.

The oscillatory movement of the drive cage 13, which occurs owing to the eccentricity EX of the mounting of the drive cage 13 within the rotatable bearing disk 17, to the driving along of the drive cage 13 by the pump head 4, and to the mutual displaceability of said elements in the direction of oscillation SR and orthogonal thereto, is readily apparent through comparison of FIGS. 6, 7, 9, 10, 12, 13, 15 and 16, and so the drive mechanism is clear. Here, the amplitude of said oscillatory movement of the diaphragm 7 corresponds to twice the eccentricity EX.

For the sake of completeness, it should also be added that the component which realizes the shuttle valve arrangement 12 with the outlet port and the inlet port 10, 11 is forced in the direction of the valve disk 24 and the pump head 4 by a compression spring arrangement 29 in the bearing bridge 9, with the result that a sealed abutment of said components against one another and a correspondingly sealed closure of the shuttle valve arrangement 12 is ensured independent of the pressure conditions at the inlet and outlet of the pump.

Figure 18:
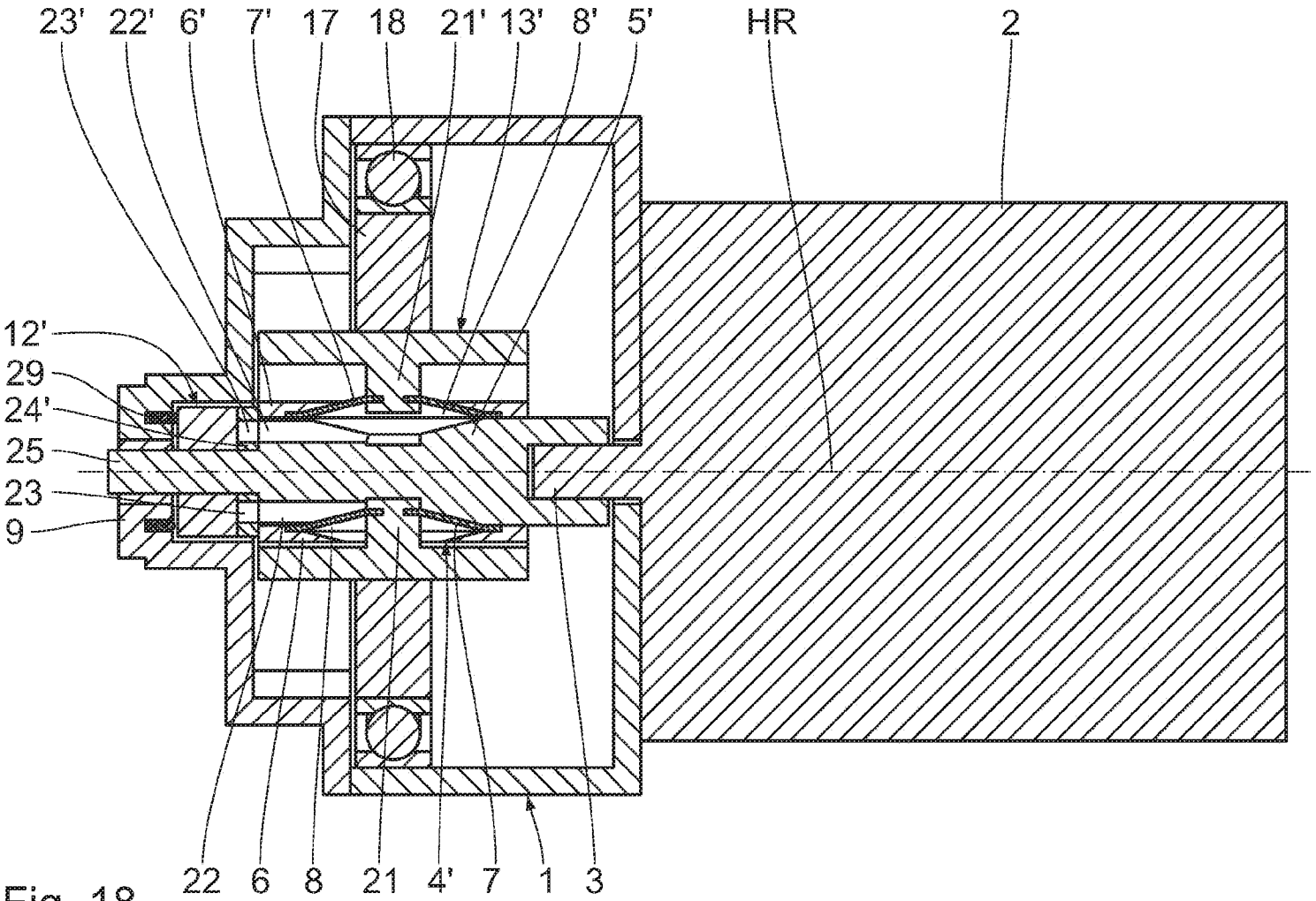
FIGS. 18 and 19 shows illustrations analogous to FIGS. 6 and 7 of a diaphragm pump, with a double pump chamber.
Figure 19:
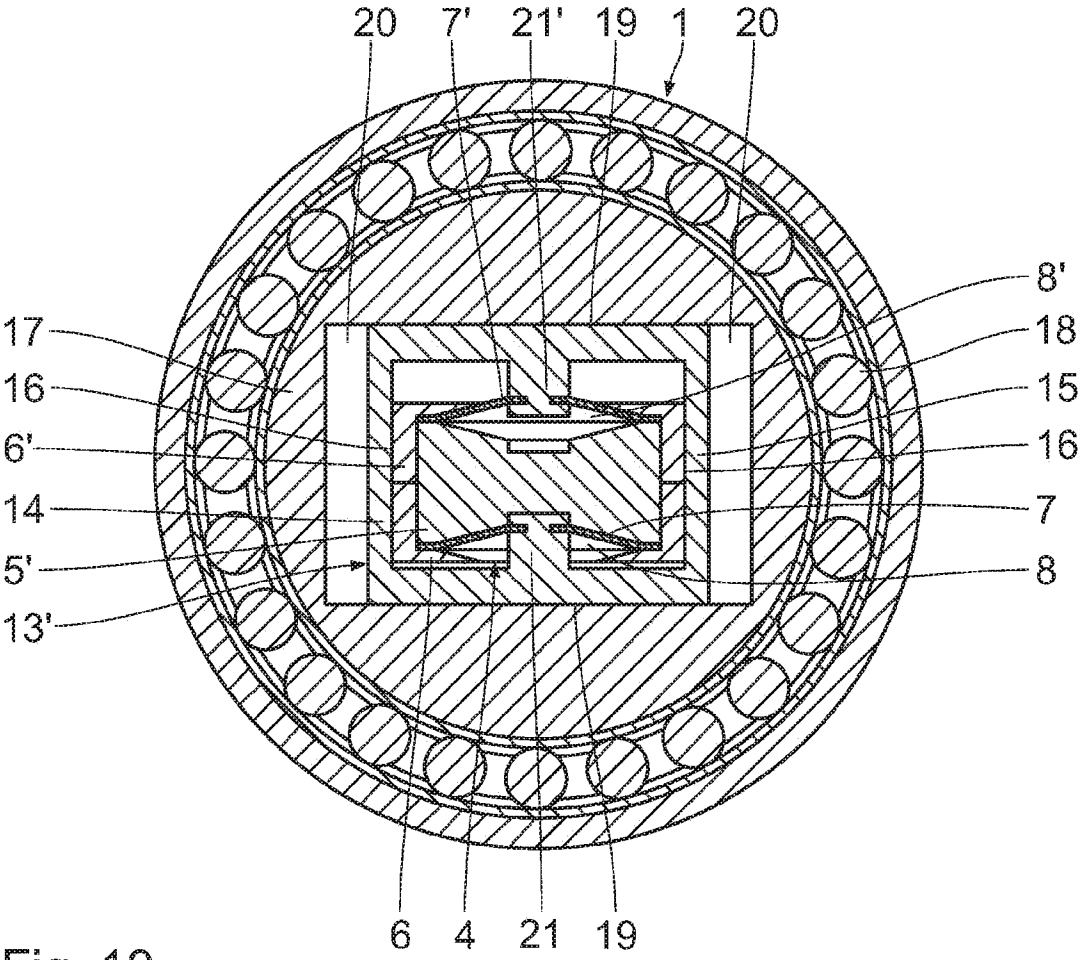
Figure 20:
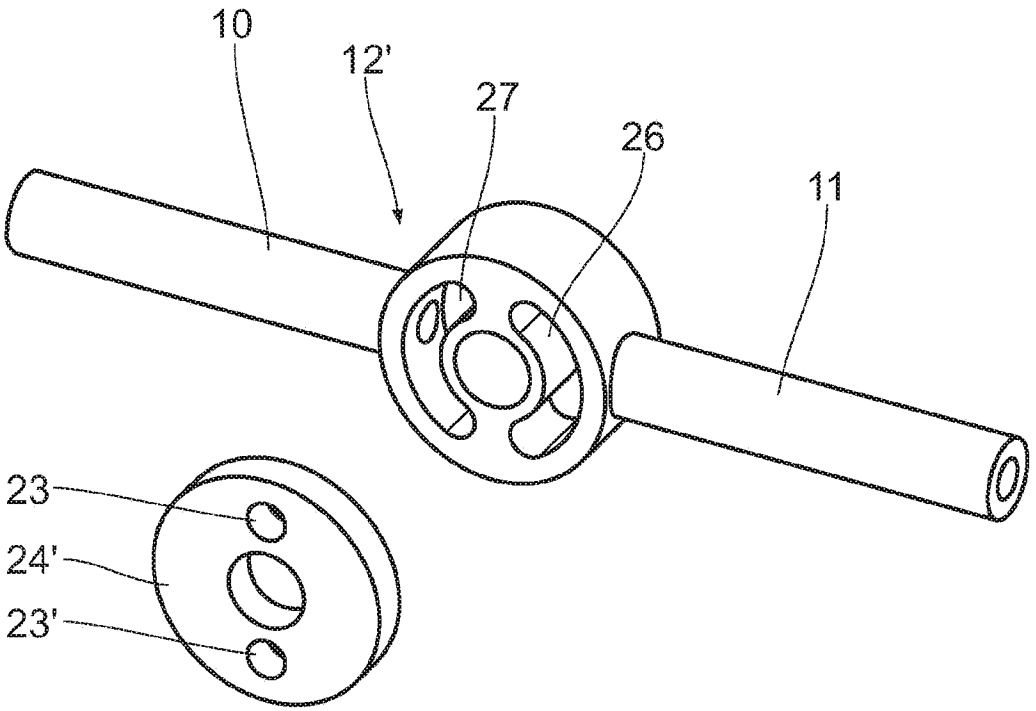
FIG. 20 shows a perspective illustration of a shuttle valve arrangement for the diaphragm pump as per FIG. 18, with a double pump chamber.

On the basis of FIGS. 18 to 20, an alternative diaphragm pump with a double pump head 4' may be discussed, said pump having two pump chambers 8, 8' which are situated mutually adjacently so as to be parallel to the main axis of rotation HR and which each have one diaphragm 7, 7'. The latter are clamped between the top part 5', which is jointly counter-abutting for both diaphragms 7, 7', and the two bottom parts 6, 6'. The drive kinematics correspond to the pump diaphragm described above, with the drive cage 13 having, merely positioned opposite the first coupling pin 21, a second coupling pin 21' which drives the second diaphragm 7'. As becomes clear from FIG. 18, the pumping medium ducts 22, 22' of the two pump chambers 8, 8' are each arranged on those sides of the pump chambers 8, 8' facing one another and lead to a valve disk 24' at which there are provided two valve openings 23, 23' offset by 180° (see FIG. 20). In the case of the deflection of the diaphragms 7, 7' into the same spatial direction, which is shown in FIGS. 18 and 19, the top dead center position, that is to say the end of the exhaust stroke, has been reached in the pump chamber 8 shown at the bottom in FIG. 18, whereas the diaphragm 7' is in the bottom dead center position, that is to say at the end of the intake stroke, in the pump chamber 8' illustrated at the top. In said position, the valve disk assumes the position, illustrated in FIG. 20, of the shuttle disk arrangement 12' in the transition region between the two part-ring ducts 26, 27. During further rotation of the pump head 4' and the corresponding displacement of the drive cage 13', with further movement of the two diaphragms 7, 7', the two valve openings 23, 23' enter into connection with the in each case other port, with the result that noticeably, during a complete revolution of the pump head 4', with brief interruptions during the transition of the valve openings 23, 23' from one part-ring duct 26 to the other part-ring duct 27, intake conditions always prevail at the intake port 11 and pressure conditions always prevail at the outlet port 10.

Otherwise, the diaphragm pump as per FIGS. 18 to 20 corresponds in its structure and functioning with the diaphragm pump as per FIGS. 1 to 17, and so a repeated description is unnecessary. Corresponding structural elements are provided with identical reference signs.

What is claimed is:

1. A diaphragm pump, comprising:

a carrier part;

a drive motor operatively coupled to the carrier part, the drive motor comprising a drive shaft configured to rotate about a main axis of rotation;

a pump head with a pump chamber is delimited by a diaphragm, the diaphragm configured to oscillate along a direction of oscillation with respect to the pump head, wherein the pump head is rotatably mounted to the carrier part and is operatively coupled to the drive shaft in an orientation such that the direction of oscillation is orthogonal to the main axis of rotation of the drive shaft;

an inlet port;

an outlet port opposite the inlet port, wherein the inlet port and the outlet port are disposed at a side of the carrier part opposite the drive motor;

a medium duct fluidly coupled to the pump chamber;

a shuttle valve configured to:

fluidly couple the medium duct to the inlet port during an intake stroke, and fluidly couple the medium duct to the outlet port during an exhaust stroke;

a drive transmission element operatively coupled to the pump head and configured to be displaceable along the direction of oscillation of the diaphragm, wherein the drive transmission element comprises a coupling element operatively coupled to the diaphragm; and a bearing disk rotatably coupled to the carrier part about an axis of rotation parallel and eccentric to the main axis of rotation of the drive shaft;

wherein the bearing disk receives the drive transmission element and is configured to guide the drive transmission element along the direction of oscillation of the diaphragm via eccentricity-induced displacements of the drive transmission element relative to the pump head and the bearing disk, and the coupling element is configured to translate with the drive transmission element to generate oscillatory movement of the diaphragm in the pump chamber during the rotation of the pump head.

2. The diaphragm pump as claimed in claim 1, wherein the drive transmission element comprises a cage part, which is guided by way of sliding guides so as to be displaceable in relation to the pump head and to the bearing disk.

3. The diaphragm pump as claimed in claim 1, wherein the coupling element of the drive transmission element is formed as a coupling pin which projects inwardly into the pump head and which is connected to the diaphragm.

4. The diaphragm pump as claimed in claim 1, wherein the bearing disk is rotatably mounted in a rolling bearing ring on the carrier part.

5. The diaphragm pump as claimed in claim 1, wherein an eccentricity of the bearing disk in relation to the main axis of rotation is up to ⅕ of a diaphragm clamping diameter.

6. The diaphragm pump as claimed in claim 1, wherein the medium duct extends from the pump chamber to the shuttle valve along a direction parallel to, and offset from the main axis of rotation in the pump head, the shuttle valve comprising two kidney-shaped ducts, which are configured to alternately connect the medium duct to the inlet port during the intake stroke and the outlet port during the exhaust stroke.

7. The diaphragm pump as claimed in claim 1, wherein the shuttle valve further comprises a sealing valve disk having a valve opening, the sealing valve disk rotates with the pump head to alternately align the valve opening with each kidney-shaped duct to alternately connect the medium duct to the inlet port and the outlet port.

8. The diaphragm pump as claimed in claim 7, wherein the shuttle valve further comprises a spring disposed between a bearing bridge of the carrier part and the shuttle valve to bias the shuttle valve towards the pump head.

9. The diaphragm pump as claimed in claim 1, wherein the pump head further comprises a bottom part and a top part with the diaphragm clamped therebetween, wherein the coupling element projects into the pump head through an opening in the bottom part for connecting to the diaphragm.

10. The diaphragm pump as claimed in claim 1, wherein the pump head further comprises a second pump chamber adjacent to the pump chamber, the second pump chamber comprising a second diaphragm driven by the drive transmission element having a second coupling element, wherein the diaphragm is synchronized with the second diaphragm with opposing strokes.

11. A diaphragm pump, comprising:

a carrier part;

a drive shaft configured to rotate about a main axis of rotation;

a pump head with a pump chamber delimited by a diaphragm, the diaphragm configured to oscillate along a direction of oscillation with respect to the pump head, wherein the pump head is rotatably mounted to the carrier part and is operatively coupled to the drive shaft in an orientation such that the direction of oscillation is orthogonal to the main axis of rotation of the drive shaft;

an inlet port;

an outlet port opposite the inlet port, wherein the inlet port and the outlet port are disposed at a side of the carrier part opposite the drive shaft;

a medium duct fluidly coupled to the pump chamber;

a shuttle valve configured to:

fluidly couple the medium duct to the inlet port during an intake stroke, and fluidly couple the medium duct to the outlet port during an exhaust stroke;

a drive transmission element comprising a coupling pin operatively coupled to the pump head and configured to be displaceable along the direction of oscillation of the diaphragm, wherein the drive transmission element comprises a coupling element operatively coupled to the diaphragm; and a bearing disk rotatably coupled to the carrier part about an axis of rotation parallel and eccentric to the main axis of rotation of the drive shaft;

wherein the bearing disk receives the drive transmission element and is configured to guide the drive transmission element along the direction of oscillation of the diaphragm via eccentricity-induced displacements of the drive transmission element relative to the pump head and the bearing disk, and the coupling element is configured to translate with the drive transmission element to generate oscillatory movement of the diaphragm in the pump chamber during the rotation of the pump head.

12. The diaphragm pump as claimed in claim 11, wherein the drive transmission element comprises a cage part, which is guided by way of sliding guides so as to be displaceable in relation to the pump head and to the bearing disk.

13. The diaphragm pump as claimed in claim 11, wherein the coupling pin which projects inwardly into the pump head to the diaphragm.

14. The diaphragm pump as claimed in claim 11, wherein the bearing disk is rotatably mounted in a rolling bearing ring on the carrier part.

15. The diaphragm pump as claimed in claim 11, wherein an eccentricity of the bearing disk in relation to the main axis of rotation is up to ⅕ of a diaphragm clamping diameter.

16. The diaphragm pump as claimed in claim 11, wherein the medium duct extends from the pump chamber to the shuttle valve along a direction parallel to, and offset from the main axis of rotation in the pump head, the shuttle valve comprising two kidney-shaped ducts, which are configured to alternately connect the medium duct to the inlet port during the intake stroke and the outlet port during the exhaust stroke.

17. The diaphragm pump as claimed in claim 11, wherein the shuttle valve further comprises a sealing valve disk having a valve opening, the sealing valve disk rotates with the pump head to alternately align the valve opening with each kidney-shaped duct to alternately connect the medium duct to the inlet port and the outlet port.

18. The diaphragm pump as claimed in claim 17, wherein the shuttle valve further comprises a spring disposed between a bearing bridge of the carrier part and the shuttle valve to bias the shuttle valve towards the pump head.

19. The diaphragm pump as claimed in claim 11, wherein the pump head further comprises a bottom part and a top part with the diaphragm clamped therebetween, wherein the coupling pin projects into the pump head through an opening in the bottom part for connecting to the diaphragm.

20. The diaphragm pump as claimed in claim 11, wherein the pump head further comprises a second pump chamber adjacent to the pump chamber, the second pump chamber comprising a second diaphragm driven by the drive transmission element having a second coupling element, wherein the diaphragm is synchronized with the second diaphragm with opposing strokes.

* * * * *